US007283966B2

(12) United States Patent
Zhang et al.

(10) Patent No.: US 7,283,966 B2
(45) Date of Patent: Oct. 16, 2007

(54) SCALABLE AUDIO COMMUNICATIONS UTILIZING RATE-DISTORTION BASED END-TO-END BIT ALLOCATION

(75) Inventors: Qian Zhang, Hubei (CN); Wenwu Zhu, Basking Ridge, NJ (US)

(73) Assignee: Microsoft Corporation, Redmond, WA (US)

( * ) Notice: Subject to any disclaimer, the term of this patent is extended or adjusted under 35 U.S.C. 154(b) by 1071 days.

(21) Appl. No.: 10/125,987

(22) Filed: Apr. 19, 2002

(65) Prior Publication Data

US 2003/0171934 A1 Sep. 11, 2003

Related U.S. Application Data

(63) Continuation-in-part of application No. 10/092,999, filed on Mar. 7, 2002, now Pat. No. 6,934,679.

(51) Int. Cl.
*G10L 19/00* (2006.01)

(52) U.S. Cl. ..... 704/500; 704/201

(58) Field of Classification Search ..... None
See application file for complete search history.

(56) References Cited

U.S. PATENT DOCUMENTS

| | | | | |
|---|---|---|---|---|
| 5,526,353 | A | 6/1996 | Henley et al. | |
| 5,856,973 | A | 1/1999 | Thompson | |
| 6,031,874 | A * | 2/2000 | Chennakeshu et al. | 375/262 |
| 6,249,319 | B1 | 6/2001 | Post | |
| 6,339,658 | B1 | 1/2002 | Moccagatta et al. | |
| 6,367,049 | B1 * | 4/2002 | Van Dijk et al. | 714/761 |
| 6,501,397 | B1 | 12/2002 | Radha et al. | |
| 6,580,834 | B2 | 6/2003 | Li et al. | |
| 6,757,659 | B1 | 6/2004 | Tanaka et al. | |
| 6,801,707 | B1 | 10/2004 | Harumoto et al. | |
| 6,934,679 | B2 * | 8/2005 | Zhou et al. | 704/230 |
| 2001/0022761 | A1 | 9/2001 | Sekii | |
| 2002/0021761 | A1 | 2/2002 | Zhang et al. | |
| 2003/0079222 | A1 | 4/2003 | Boykin et al. | |

OTHER PUBLICATIONS

"Error Resilient Scalable Audio Coding (ERSAC) For Mobile Applications", Jianpin Zhou, Qian Zhang, Zixiang Xiong and Wenwu Zhu, 4 pages, Proc. of IEEE Workshop Multimedia Signal Processing, Cannes, France, Oct. 2001.

(Continued)

*Primary Examiner*—David D. Knepper
(74) *Attorney, Agent, or Firm*—Lee & Hayes, PLLC

(57) ABSTRACT

A source encoder encodes audio signals into increasing quality layers defined in bit planes. Each bit plane has a data unit that includes a beginning partition having one or more contiguous refinement bits, a second partition having one or more contiguous coded significance bits, a third partition having one or more contiguous sign boundary mark bits, and a fourth partition having one or more contiguous coded sign bits. A channel encoder encodes the bit planes into respective columns containing multiple rows. Unequal error protection coding is provided according to the quality of each layer such that each row has row and column channel protection codes for the respective row and column that correspond to the respective quality layer. For the corresponding row and column, each row contains the row channel protection codes and either the compressed audio data from the respective layer or the column channel protection codes. A server machine can use a network feedback transmission to allocate bits to the source encoder and the channel encoder.

58 Claims, 9 Drawing Sheets

OTHER PUBLICATIONS

"A Class of Reversible Variable Length Codes for Rubust Image and Video Coding", Jiantao Wen and John D. Villasenor, 4 pages, In Proc. Int. Conf. on Imaging Processing, Santa Barbara, CA Oct. 26-29, 1997, pp. 65-68, vol. 2, IEEE, Piscataway, NJ.

* cited by examiner

SCALABLE AUDIO COMMUNICATIONS UTILIZING RATE-DISTORTION BASED END-TO-END BIT ALLOCATION

This is a continuation-in-part of U.S. patent application Ser. No. 10/092,999, filed on Mar. 7, 2002, now U.S. Pat. No. 6,934,679, titled "Error Resilient Scalable Audio Coding".

TECHNICAL FIELD

The present invention relates to systems and methods for streaming media (e.g. audio) over a network, such as the wireless Internet.

BACKGROUND OF THE INVENTION

With the advent of the Internet age, streaming high-fidelity audio has become a reality. It is thus natural to extend audio streaming to wireless communications so that mobile users can listen to music from handheld devices. With the emerging of 2.5G (GPRS) and the third generation (3G) (CDMA2000 and WCDMA) wireless technology, streaming high-fidelity audio over wireless channels and networks has also become a reality. Internet Protocol (IP) based architecture is promising to provide the opportunity for next-generation wireless services such as voice, high-speed data, Internet access, audio and video streaming on an all IP network. However, delivering or streaming high-fidelity audio across wireless IP networks still remains challenging due to a limited varying bandwidth. Scalable audio coding (SAC) can efficiently accommodate the varying bandwidth of wireless IP channels and networks. A scalable audio bitstream typically consists of a base layer plus a number of enhancement layers. It is possible to use only a subset of the layers to decode the audio with lower sampling resolution and/or quality. In streaming applications, several lower layers in a scalable audio bitstream are selectively delivered to adapt to network bandwidth fluctuation and packet loss level. For example, when the available bandwidth is low or the packet loss ratio is high, only the base layer is transmitted.

Delivering or streaming high-fidelity audio over wireless IP channels and networks is also challenging because the wireless IP channels and networks present not only packet erasures errors caused by large-scale path loss and fading, but also random bit errors due to the wireless connection. These bit errors have an adverse effect on decompressing the received audio bitstream and can cause the decoder to be come inoperative (e.g. the decoder will crash). To combat these bit errors, forward error correction (FEC) can be used to protect the compressed data. However, no matter how carefully the compressed data are protected before transmission, the received data may still have bit errors.

Considering the limited bandwidth in wireless IP channels and networks, efficient compression techniques can be applied to audio signals but there will be a lessening in sensitivity to transmission errors. To cope with bit errors on wireless IP channels and networks, conventional error resilience (ER) techniques can be used. Error resilience techniques at the source coding level can detect and locate errors, support resynchronization, and prevent the loss of entire data units. With ER techniques, audio quality can be obtained at a bit error rate of about $10^{-5}$. The bit error rate in the wireless channel, however, can be significantly higher.

Conventional ER techniques for video coding cannot be directly ported to audio coding because the characteristics of audio and video are different. In video coding there exists a strong correlation between adjacent video frames and this correlation can be exploited to recover data that is corrupted in transmission. In contrast, there is almost no correlation between adjacent audio frames in the time domain. Moreover, audio coding artifacts caused by corrupted frames are esthetically undesirable to human auditory sensibilities.

Error protection schemes can be used for audio streaming over a channel such as the Internet or a wireless network, including Unequal Error Protection (UEP) schemes and FEC error control schemes. A common deficiency of such error protection schemes is the failure to consider varying channel conditions and the inability to handle bit errors and packet erasures simultaneously while minimizing end-to-end distortion for scalable audio streaming. Thus, there is a need for improved methods, apparatuses, computer programs, data structures, and systems that can provide such a capability.

In the scalable audio codec, the audio signal is first split into individual time segments, which are filtered by a polyphase quadrature filter (PQF) and down-sampled into four subbands to facilitate scalability in sampling resolution. A modified DCT (MDCT) is then performed on each subband and the resulting MDCT coefficients are weighted by a psychoacoustic mask function. Finally, each weighted subband is encoded into an embedded audio bitstream using bit-plane coding, where each bit plane is coded into one layer or data unit (DU). FIG. 2 illustrates the syntax of a conventional scalable audio bitstream for one (1) data unit (DU) of one (1) coded bit-plane. The DU seen in FIG. 2 is formed by a process where each weighted subband of audio data is encoded into an embedded bitstream using bit-plane coding. Each bit plane is coded into one (1) layer or DU. FIG. 2 demonstrates that each DU in the audio bitstream includes strings of significance bit and strings of sign bits. All of the strings of the significance and sign bits precede a string of refinement bits in the DU. The DU can be byte-aligned by the addition of dummy zeros to the end thereof as seen in FIG. 2. In a scalable audio codec, the decoder can quantize the DU in each bit-plane in the embedded audio bitstream to produce quantized data of weighted subbands. The decoder can then dequantize the quantized data of weighted subbands into audio signals.

None of the sign bits or the refinement bits in the DU is entropy coded. As such, bit errors among the sign and refinement bits will not propagate. In contrast, the significance bits are compressed with variable length codes (VLC). When an error occurs in the portion of the DU that includes the coded significance bits and the coded sign bits, the error will propagate to each of the coded significance bits, the coded sign bits, and the coded refinement bits. The multiplexing of the DUs makes the situation more complex because when the decoder detects an error, the decoder can not identify the exact location of the error. As a result, the whole DU must be discarded, regardless of where the error occurs. Thus, it would be an advance in the art to develop an ER audio coding technique to reduce error propagation, to reduce error propagation in a DU, and to reduce the discarding of DUs. Consequently, there is a need for improved methods, apparatuses, computer programs, data structures, and systems that can provide such a capability.

BRIEF SUMMARY OF THE INVENTION

A rate-distortion based bit allocation scheme based upon network status is used, in accordance with embodiments of the present invention, to determine both a channel-coding rate of a channel encoder and a source-coding rate for a source encoder so as to minimize the expected end-to-end distortion for the scalable audio streaming.

In other embodiments of the present invention, techniques are used for error resilient scalable audio streaming of increasing quality layers over wireless networks. Unequal error protection is applied as a layered-product-code by way of row and column channel protection codes for the different layers based on their respective quality impact so as to handle random bit errors and packet losses simultaneously. The row and column channel protection codes are included with the increasing quality layers in a logical arrangement into respective columns. Each column is logically arranged into rows where each row has row channel protection codes for the respective row and each column has column channel protection codes that correspond to the respective layer. For the corresponding row and column, each row contains the row protection codes, and also contains either compressed audio data from the respective layer or the column protection codes. For any column including one layer that is of higher quality than that of another column, the row and column protection codes are fewer and the compressed audio data is greater.

In still further embodiments of the present invention, an error resilient scalable audio source coding (ERSAC) scheme is proposed for mobile applications in an end-to-end streaming architecture for the delivery or streaming of audio bitstreams over wireless IP channels and networks. Error-resilience and bitstream scalability can be effectively enhanced by ERSAC in the delivery or streaming of high-fidelity audio over wireless IP channels and networks. ERSAC can be accomplished using a source encoding algorithm that encodes streaming audio data while performing data partitioning and reversible variable length coding (RVLC) in a scalable audio bitstream so as to achieve error resilience, reduce packet erasures errors, and reduce random bit errors. The data partitioning is applied to limit error propagation between different data partitions in a data unit (DU), while RVLC is used by a source decoder as an error robustness scheme to locate errors and minimize the propagation thereof.

In another embodiment of the present invention, streaming data is encoded into data units with an encoding algorithm. Each data unit includes a coded significance bits partition between a coded refinement bits partition and a sign boundary mark (SBM) bits partition. The SBM bits partition contains a string of sign boundary mark bits that is not used in the encoding algorithm to encode streaming audio data.

DETAILED DESCRIPTION OF THE PREFERRED EMBODIMENTS

Figure 1:
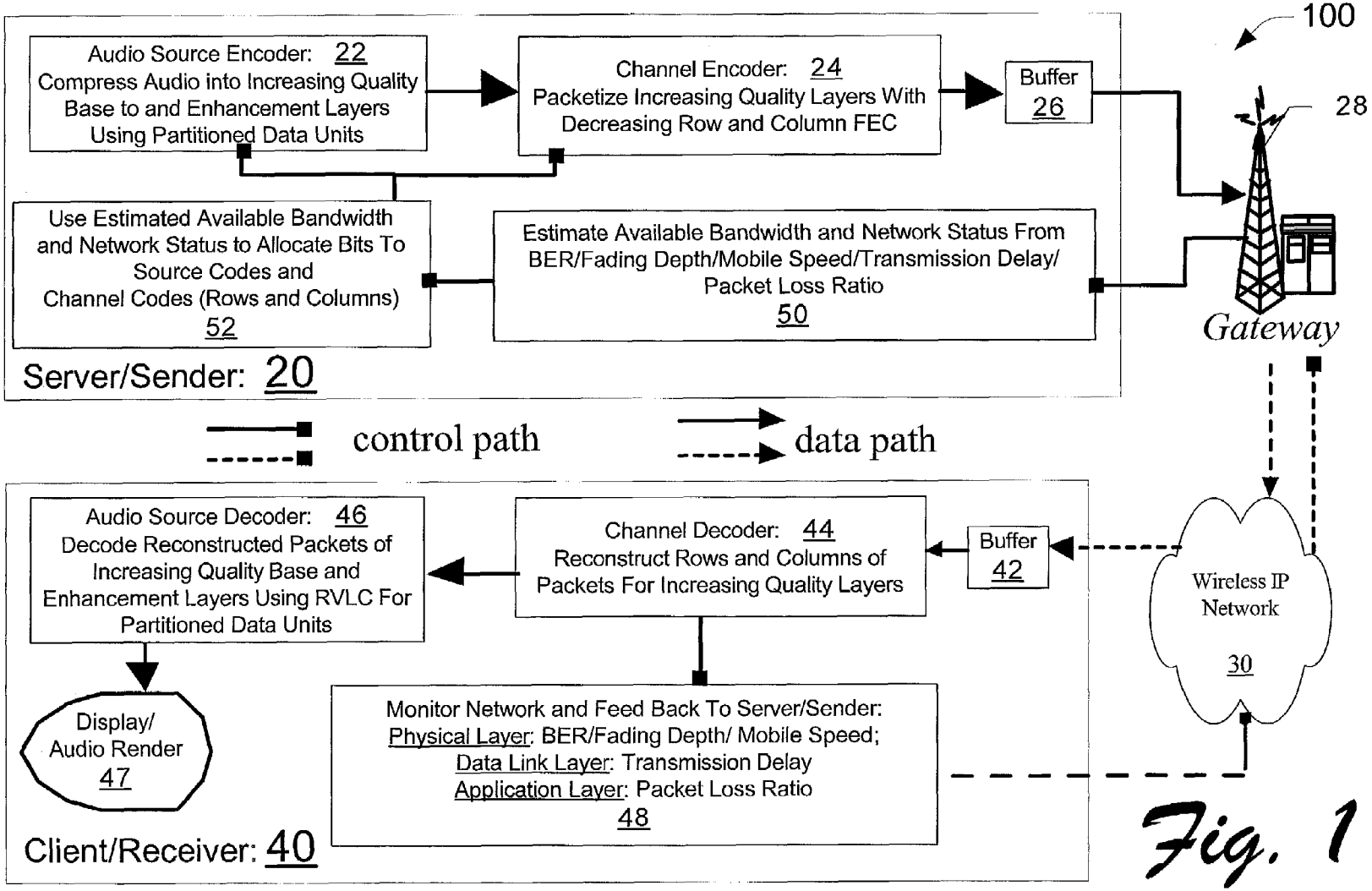
FIG. 1 is flow diagram showing a detail view of a framework for scalable audio streaming over a wireless network that includes networked client/server machines.

I. End-to-End Architecture for Scalable Audio Streaming over a Wireless IP Network FIG. 1 depicts a general client/server network system and environment 100 in which there can be implemented an end-to-end delivery architecture for scalable audio streaming over wireless networks in accordance with an embodiment of the present invention. The flow of data in FIG. 1 is depicted by solid and dashed lines each with an arrow head at the terminus thereof. The flow of control in FIG. 1 is depicted by solid and dashed lines each with a block at a terminus thereof. Several components are depicted in FIG. 1, including a server/sender 20, a gateway 28, a wireless IP network 30, and a client/receiver 40. The server/sender 20 includes an audio source encoder 22, a channel encoder 24, and a buffer 26. The client/receiver 40 seen in FIG. 1 includes a buffer 42, a channel decoder 44, an audio source decoder 46, and a component 48 to monitor the status of wireless IP network 30 for sending feedback to the server/sender 20. The server/sender 20 is depicted in FIG. 1 as having a component 50 to estimate an available bandwidth of the wireless IP network 30 and the status thereof using the feedback sent from the client/receiver 40. Also seen in FIG. 1 is a component 52 of the server/sender 20 that uses the estimated available bandwidth and the network status to allocate bits to the source codes for the audio source encoder 22 and to allocate bits to the channel codes for the channel encoder 24.

At the server/sender 20, a raw audio signal is input into the audio source encoder 22. The audio source encoder 22, which forms several quality layers from the raw audio signal, is one component of the server/sender 20 that can be used to reduce or otherwise avoid transmission errors in the system in that it can perform data partitioning in the scalable audio bitstream. The audio source decoder 46 can perform reversible variable length coding (RVLC) in the scalable audio bitstream. Specifically, the data partitioning reorganizes the scalable audio bitstream so that errors can be detected and recovered more quickly. The RVLC codes are special variable length coding (VLC) codes with a prefix property such that the RVLC codes can be uniquely decoded from both the forward and reverse directions. As such, the audio source decoder 46 can better isolate the location of an error so as to achieve better data recovery.

After source coding by the audio source encoder 22 that produces a compressed audio stream, the channel encoder 24 receives the compressed audio stream. The channel encoder 24 prepares the compressed audio stream for transmission through the gateway 28 to the wireless IP network 30 for delivery to the client/receiver 40. The channel encoder 24 performs a packetization process on the compressed audio stream as well as performing some form of error protection techniques. The packetization process logically arranges each of the several quality layers formed by the audio source encoder 22 into a column that has a plurality of rows or packets. Row and column protection codes are added in the packetization process for use in a layered-product-code based error protection technique. The packetization process performed by the channel encoder 24 divides each layer into packets or blocks and applies unequal protections both within and across the packets or blocks. The layered-product-code based error protection technique can be used to recover from different types of transmission errors, including packet loss and random bit errors which may occur simultaneously.

The client/receiver 40 receives a transmission of the packets from the server/sender 20. The reconstructed packets are buffered at buffer 42 and directed to the channel decoder 44 of the client/receiver 40. The client/receiver 40 uses a component 48 to monitor and convey the channel conditions of the wireless IP network 30 back to the server/sender 20. The monitoring component 48 monitors and collects network parameters from different layers of an IP transmission protocol. These parameters, which are fed back to the server/sender 20 by the physical layer of the IP protocol, include the channel bit error rate (BER), the fading depth, and the mobility speed of the client/receiver. The network monitor 48 also monitors and collects the transmission delay which is fed back by the data link layer. The packet loss ratio is fed back in the application layer. Once these parameters are received by the server/sender 20, module 50 can adopt a model to dynamically estimate the status of the wireless IP network 30 and its available bandwidth. Then, module 52 of the server/sender 20 can allocates bits to the channel codes for use by the channel encoder 24 and can allocate bits to the source codes for use by the audio source encoder 22. Since the influence of residual bit errors and packet losses on the decoded audio quality can be considered simultaneously when allocating resources, the end-to-end distortion can be modeled and minimized for scalable audio transmission over the wireless IP network 30. As such, an optimized bit allocation can be made among the row channel protection codes from the channel encoder 24, the column channel protection codes from the channel encoder 24, and the source codes from the audio source encoder 22 to achieve the minimal expected end-to-end distortion at the client/receiver 40.

II. Error Resilient Scalable Audio Coding

A. Data Partitioning.

Figure 3:
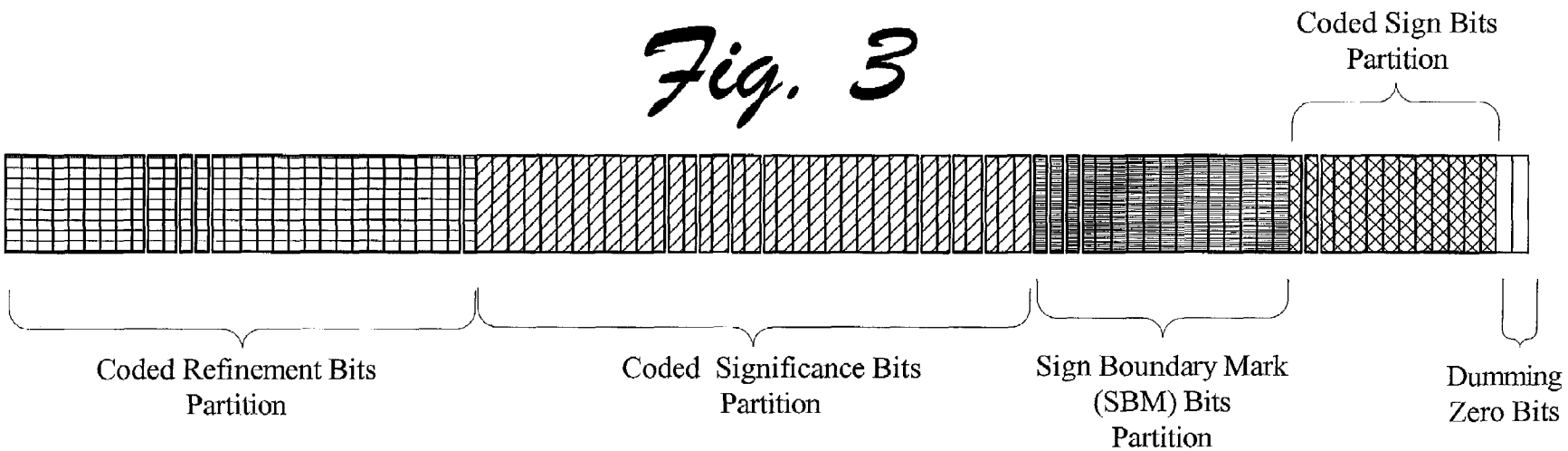
FIG. 3 is an overview, in accordance with an embodiment of the present invention, for explaining an inventive scalable audio bitstream for one (1) data unit (DU) of one (1) coded bit-plane in any of a variety of information mediums, such as a recordable/reproducible compact disc (CD).

An audio source encoder 22, such as that seen in FIG. 1, can be used to perform data partitioning of data structures. The syntax of such a data structure, in accordance with an embodiment of the present invention, is seen in FIG. 3. FIG. 3 depicts a scalable audio bitstream for one (1) data unit (DU) of one (1) coded bit-plane. As seen in FIG. 3, several independent partitions are identified in the DU, including a first partition of a string of coded refinement bits, a second partition of a string of coded significance bits, a third partition of a string of Sign Boundary Mark (SBM) bits, and a fourth partition of a string of coded sign bits. The length of the string of SBM bits is sixteen bits (e.g. two bytes). Preferably, the string of SBM bits will have a length of two or three bytes, which is relatively small compared to the length of the entire DU.

Figure 2:
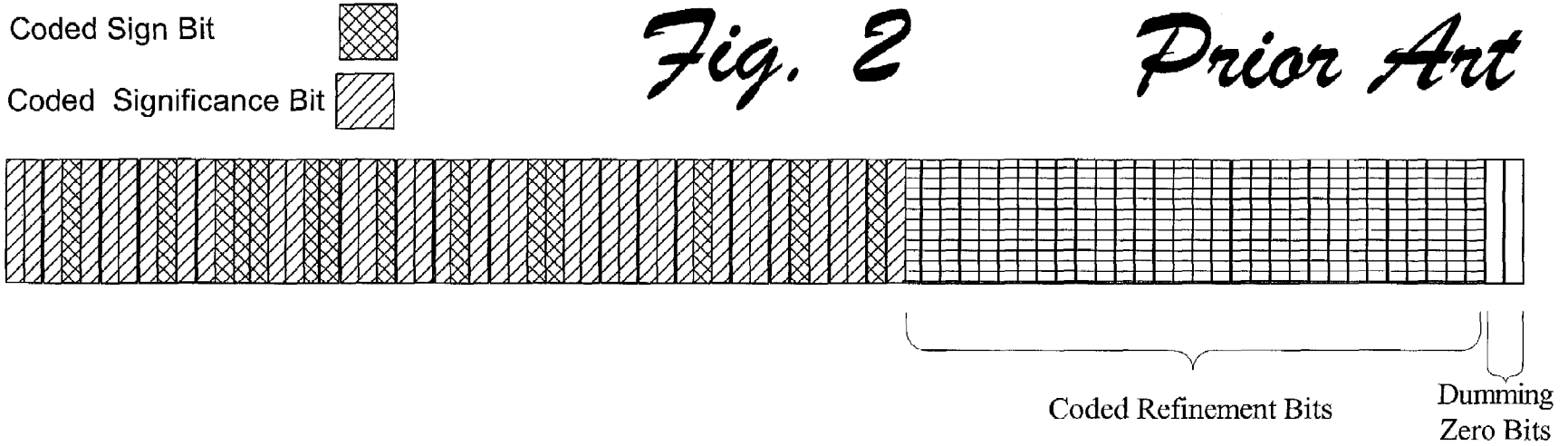
Fig. 2 Prior Art
FIG. 2 is an overview for explaining a conventional scalable audio bitstream for one (1) data unit (DU) of one (1) coded bit-plane in any of a variety of information mediums, such as a recordable/reproducible compact disc (CD).

Whereas FIG. 2 showed an interleaving of coded refinement bits, coded sign bits, and coded significance bits in the syntax of one (1) data unit (DU) of one (1) coded bit-plane, FIG. 3 depicts the de-interleaving of the coded refinement bits, the coded sign bits, and the coded significance bits in the DU into independent partitions. The order of the partitions is, respectively, the coded refinement bits partition, the coded significance bits partition, an added partition containing a string of SBM bits, and the coded sign bits partition. The ordered independent partitions enable a decoder to locate and restrict any error in the DU to a particular partition. To locate errors among the partitions seen in FIG. 3, it is preferable that the decoder be able to identify a boundary for each of the partitions. This identification is made possible by placing the coded refinement bits into an independent first partition before the bits in the coded significance bits partition, the SBM bits partition, and the coded sign bits partition. In this way, the decoder can deduce the size of the refinement bits partition from the DUs in the previous layer. This resolves the ambiguity about the coded refinement bits partition of each DU. To accomplish the task, the SBM bits partition is added to distinguish the coded significance bits from the coded sign bits in each DU. Because the VLC used by the encoder has a finite code tree, the bit string in the SBM bits partition can be selected to be an invalid codeword. In addition, and for error robustness reasons, the bit string in the SBM bits partition can be selected so as to be sufficiently far in terms of Hamming distance from valid codewords so that the bit string in the SBM bits partition can be detected even if the SBM bits partition is corrupted.

The foregoing discussion is applicable to a scalable audio coding apparatus for coding audio signals, such as audio source encoder 22 seen in FIG. 1. The apparatus includes a signal processor for signal-processing input audio signals, a quantizer, and an encoder. The quantizer quantizes the signal processed input audio signals into quantized data of weighted subbands. The encoder bit-plane codes the quantized data into an embedded audio bitstream of bit-planes. The embedded audio bitstream includes binary data having bits. Each bit-plane has a data unit that includes a beginning partition having one or more contiguous refinement bits, a second partition having one or more contiguous coded significance bits, a third partition having one or more contiguous sign boundary mark (SBM) bits, and a fourth partition having one or more contiguous coded sign bits. The third partition is between the second and fourth partitions. Each data unit can have a last partition filled with dummy zeros so as to assure that the data unit is byte-aligned.

The encoder can use a VLC algorithm having a finite code set. Preferably, the bit-plane coding of encoder will generate the third partition as an invalid codeword for the predetermined coding method. The invalid codeword generated by the predetermined coding method can be a significant Hamming distance from valid codewords of the predetermined coding method so that the SBM bits in the third partition can be detected even if it is corrupted.

B. Reversible Variable Length Codes (RVLC)

An encoder of a codec can be used to code the audio bitstream using reversible variable length codes (RVLC). RVLC are special VLC that can be decoded instantaneously both in the forward and backward directions. When bit errors occur, the decoder can locate them by comparing the decoding results in the two different directions. Reversible exponential Golomb (Exp-Golomb) codes are a form of RVLC. As an extension of the Exp-Golomb codes, reversible Exp-Golomb codes have a length distribution identical to the Exp-Golomb codes. Therefore, they can increase the robustness of channel errors while suffering no loss in coding efficiency. The RVLC algorithm and Reversible Exp-Golomb codes, as described herein, can be used in different audio codecs.

Like Golomb codes, Exp-Golomb codes are associated with an order in a way of a small order for coding small entropy sources and a large order for large entropy sources. For binary bits, the optimal value of the order can be calculated by the probability of the occurrence of the zero bits. According to the order, each codeword includes a variable-length prefix part and a fixed-length suffix part. Exp-Golomb Codes are not sensitive to the value of the order and the range of the order is somewhat limited. Hence, the selection of a suitable order is not difficult. The value of the order is determined by the property of the coded significance bits in the DU after bit-plane coding. Preferably, the order will be set to one (1) in the first two bit-planes and will be set to two (2) in other bit-planes.

Reversible Exp-Golomb codes are applied to the coded significance bits in the ERSAC scheme. As mentioned above, the codewords have a finite code tree. Some nodes on the code tree are invalid and can serve as "traps" to detect errors. Once the decoder encounters an invalid codeword, the decoder can then recognize that errors exist in the bitstream, although the decoder can not identify exact positions. Normally the received significance data are decoded both in the forward and backward directions. In case of an error, the decoder will locate the error from either the forward decoding pass or from the backward decoding pass.

It is preferable that the decoder be enabled with error handling capability, particularly for the suppression of propagating errors. Non-propagating errors have limited impairments to the whole bitstream and they are tolerable by the decoder. In contrast, the propagating errors can have significant impairments as to render the decoder inoperative (e.g. the decoder will crash). Hence, the propagating errors should be detected and located by the decoder. Errors in the sign and refinement bits are non-propagating. It is preferable that the decoder detect errors in the coded significance bits, which have preferably been coded with reversible Exp-Golomb codewords. Each reversible Exp-Golomb codeword includes a variable-length prefix and a fixed-length suffix. A bit error in the fixed-length suffix is non-propagating. Whether a bit error in the variable-length prefix is a propagating error or a non-propagating error depends on the specific location of the bit error. A bit error in an odd position in the variable-length prefix is a propagating error, while a bit error in an even position in the variable-length prefix is non-propagating error.

Since a propagating error can occur only in the coded significance bits, error handling is applied only to the coded significance bits. There is an upper limit on the coded run length of the coded significance bits. Once the length of a run exceeds the upper limit, it will be split into multiple runs for independent decoding. However, there is a tradeoff in terms of how to choose the upper limit. On one hand, it is not desirable to code long run lengths into one codeword. Once a codeword is corrupted by a bit error, it may incur a large error in subsequent decoding. In addition, it is important to have a finite code tree, which is necessary for the selection of the SBM bits partition and the RVLC. To allow more invalid codewords, the upper limit will preferably be relatively small so that a relatively small code tree can be obtained. In other words, it is more preferable to have a relatively small upper limit for error resilience. On the other hand, splitting the long run lengths may reduce the coding efficiency.

Due to the data partitioning in general and the SBM bits partition in particular, the boundary of the coded significance bits can be known in advance. RVLC can then be used to track and locate the errors. Normally the coded significance bits are decoded both in the forward and backward directions. When an error (e.g., an invalid codeword) is detected, the reversible Exp-Golomb decoder will stop and locate the error in either decoding direction. Furthermore, the scheme can be used to apply sanity checks on the decoded significance bits because the number of the coded significance bits is known before decoding and the number of binary ones ("1") in the coded significance bits must be identical to the number of sign bits. If no errors are detected in both the forward and backward decoding directions and the decoded data passes the sanity check, the decoding result will be understood to be correct. If an error occurs in decoding, the decoding results of both the forward and backward decoding directions will be compared and identical portions in the two decoding results will then be considered to be correct. By this means, the most potentially correct bits can be utilized in the subsequent source decoding stage.

The foregoing discussion is applicable to a scalable audio decoding apparatus. The decoding apparatus includes a decoder to decode and dequantize an embedded audio bitstream of bit-planes received from an encoder. The quantizing produces quantized data of weighted subbands. The decoding apparatus also includes an inverse quantizer to dequantize the quantized data of weighted subbands into audio signals. In addition, the decoder decodes the coded significance bits in the second partition of each DU using Reversible Exp-Golomb codewords that include a variable-length prefix part and a fixed-length suffix part. The decoder performs an error detection procedure upon the variable-length prefix of the coded significance bits in both forward and backward directions to detect an invalid codeword. Upon detection of an invalid codeword, the decoder identifies a location of the invalid codeword in the variable-length prefix of the coded significance bits. Once the invalid codeword has been identified and located, it is preferred that the decoder derive a result for an error detection in the forward direction with a result for an error detection in the backward direction. These two results are compared to determine identical portions of the variable-length prefix of the coded significance bits. The identical portions are then accepted by the decoder.

Better quality delivered audio can be achieved by ERSAC over conventional SAC in that audio is rendered such that pauses or artifacts tend to be imperceptible to common listeners.

General Network Structure

Figure 4:
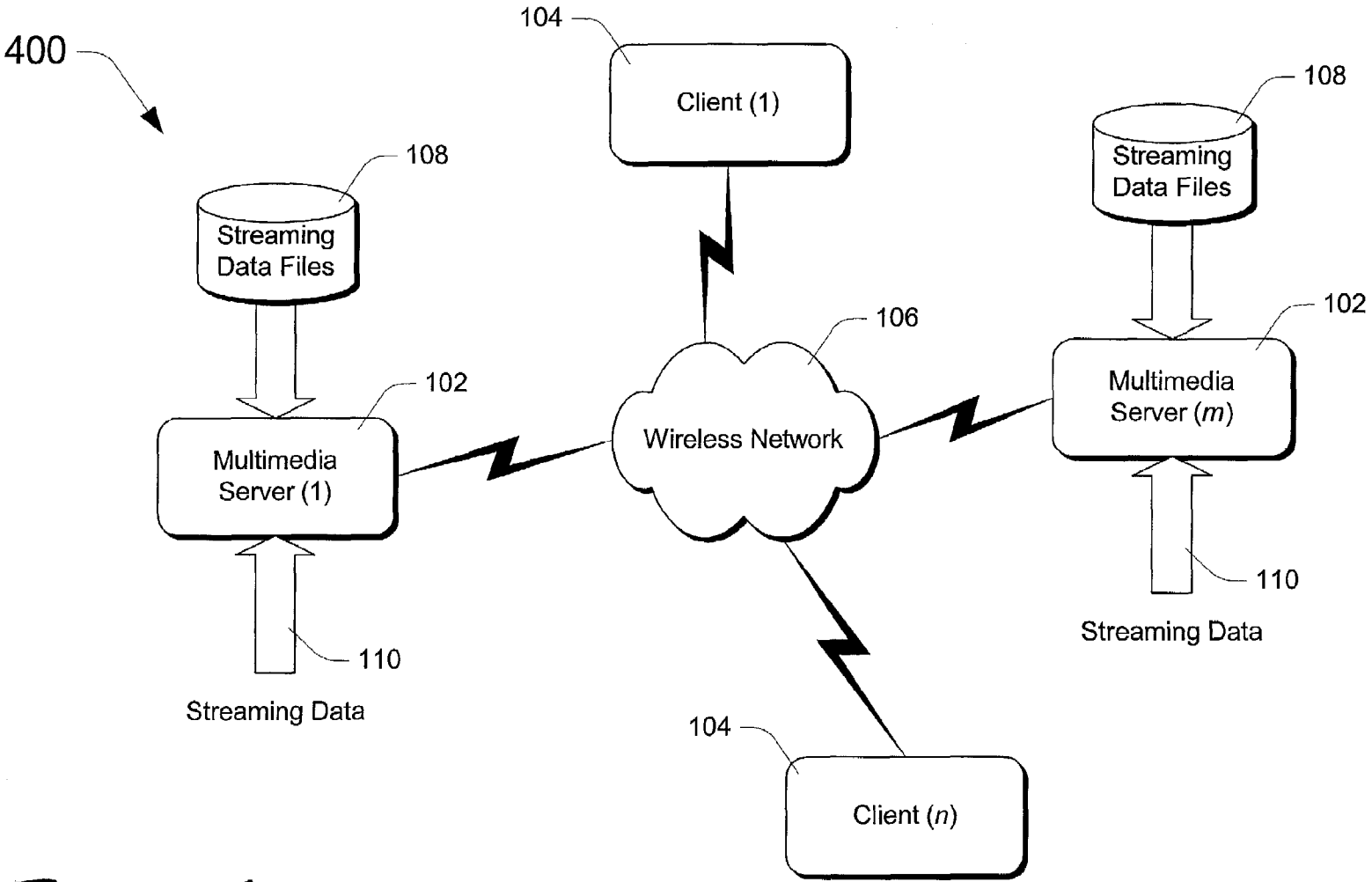
FIG. 4 is a block diagram, in accordance with an embodiment of the present invention, of a networked client/server system.

FIG. 4 shows a general client/server network system and environment 400, in accordance with an embodiment of the present invention, for encoding scalable audio streaming over wireless IP channels and networks for data units depicted in FIG. 3. Generally, the system and environment 400 includes one or more (m) network server computers 102, and one or more (n) network client computers 104. The computers communicate with each other over a data communications network, which in FIG. 4 includes a wireless network 106. The data communications network might also include the Internet or local-area networks and private wide-area networks. Network server computers 102 and network client computers 104 communicate with one another via any of a wide variety of known protocols, such as the Real-time Transport Protocol (RTP) or User Datagram Protocol (UDP).

Each of the m network server computers 102 and the n network client computers 104 can include an error resilient scalable audio codec for performing error resilient scalable audio coding (ERSAC) as discussed above. On the sender side, a raw audio signal is first put into the scalable audio encoder to form several quality layers. The error resilient source encoder is the first component to combat the transmission errors in the system and environment 400. The scalable audio encoder performs data partitioning in the scalable audio bitstream. Data partitioning reorganizes the scalable audio bitstream so that errors can be detected and recovered more quickly. On the receiver side, the decoder of the codec performs RVLC using Reversible Exp-Golomb codes having a prefix property such that they can be uniquely decoded in the forward direction and also in the reverse direction. As such, the decoder can better isolate the location of errors for better data recovery.

Network server computers 102 have access to streaming media content in the form of different media streams. These media streams can be individual media streams (e.g., audio, video, graphical, etc.), or alternatively composite media streams including multiple such individual streams. Some media streams might be stored as files 108 in a database or other file storage system, while other media streams 110 might be supplied to the network server computer 102 on a "live" basis from other data source components through dedicated communications channels or through the Internet itself. The media streams received from network server computers 102 are rendered at the network client computers 104 as an audio presentation, which can include media streams from one or more of the network server computers 102. A user interface (UI) at the network client computer 104 can allows users various controls, such as allowing a user to either increase or decrease the speed at which the audio presentation is rendered.

Exemplary Computer Environment

In the discussion below, the invention will be described in the general context of computer-executable instructions, such as program modules, being executed by one or more conventional personal computers. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. In a distributed computer environment, program modules may be located in both local and remote memory storage devices. Alternatively, the invention could be implemented in hardware or a combination of hardware, software, and/or firmware. For example, one or more application specific integrated circuits (ASICs) could be programmed to carry out the invention.

As shown in FIG. 4, general client/server network system and environment 400 in accordance with the invention includes network server computer(s) 102 from which a plurality of media streams are available. In some cases, the media streams are actually stored by network server computer(s) 102. In other cases, network server computer(s) 102 obtain the media streams from other network sources or devices. The system also includes network client computer(s) 104. Generally, the network client computer(s) 104 are responsive to user input to request media streams corresponding to selected multimedia content. In response to a request for a media stream corresponding to multimedia content, network server computer(s) 102 streams the requested media streams to the network client computer 104, where the streams have a format in accordance with the data structure seen in FIG. 3. The network client computer 104 audio renders the data streams to produce an audio presentation.

FIG. 4 illustrates the input and storage of audio data on server 102, as well communications between server 102 and client 104 in accordance with an embodiment of the present invention. By way of overview, the server 102 receives input of an audio data stream. The server 102 encodes the audio data stream using the encoder of the server's ERSAC codec. The ERSAC formatted data stream is then stored by the server. Subsequently, client 103 requests the corresponding audio data stream from server 102. Server 102 retrieves and transmits to client 104 the corresponding audio stream that server 102 had previously stored in the ERSAC format. Client 104 decodes the ERSAC audio stream, which client 104 has received from server 102, using the decoder of the client's ERSAC codec so as to perform audio rendering.

Figure 5:
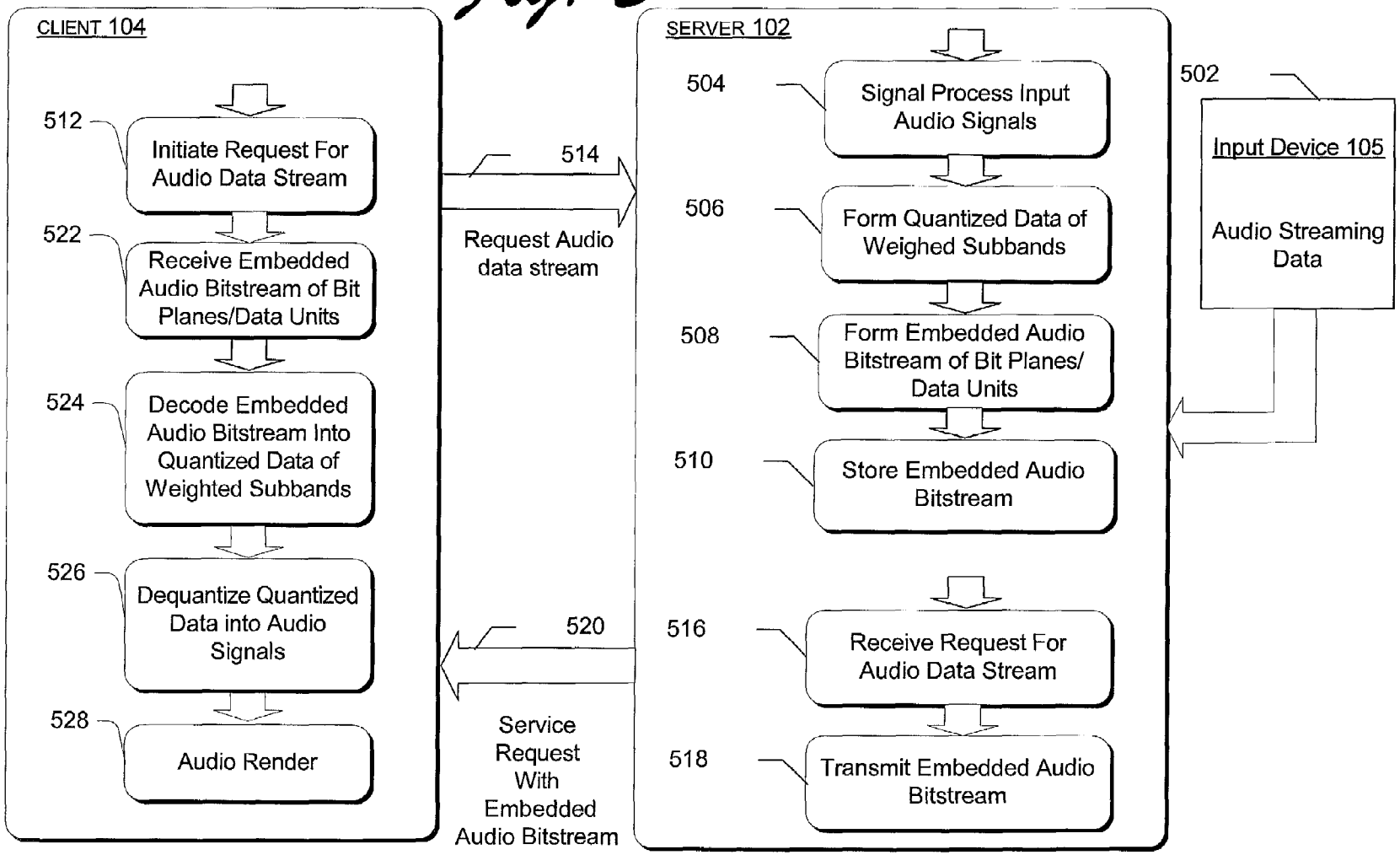
FIG. 5 is a block diagram, in accordance with an embodiment of the present invention, illustrating communications between a client and a server, where the server serves to the client a requested embedded audio bitstream that the client can decode and audio render.

The flow of data is seen in FIG. 5 between and among blocks 502-528. At block 502, an input device 105 furnishes to network server computer 102 an input that includes audio streaming data. By way of example, the audio streaming data might be supplied to network server computer 102 on a "live" basis by input device 105 through dedicated communications channels or through the Internet. The audio streaming data is supplied to a signal processor of network server computer 102 at block 504 for processing of audio signals. At block 506, quantized data of weighed subbands is formed from the processed input audio signals.

At block 508, an embedded audio bitstream is formed so as to include bit planes, where each bit plane has a data unit such as is seen in FIG. 3. The embedded audio bitstream so constructed is then stored at block 510, such as in streaming data files 108 seen in FIG. 4.

Network client computer 104 makes a request for an audio data stream at block 512 that is transmitted to server 102 as seen at arrow 514 in FIG. 5. At block 516, server 102 receives the request and transmits a corresponding embedded audio bitstream as seen in blocks 518-520. The embedded audio bitstream is received by network client computer 104 at block 522. At block 524, the network client computer 104 employs a decoder to decode the embedded audio bitstream into quantized data of weighted subbands. Preferably, the decoding will be performed using reversible Exp-Golomb codes as discussed above. At block 526, the decoder dequantizes the quantized data into audio signals. At block 528, the decoder audio renders the decompressed audio signals.

III. Layer-Product-Code Based Error Protection for Scalable Audio

Forward error correction (FEC) techniques can be used by a channel encoder, such as that seen in FIG. 1, for error protection. The idea of FEC is to transmit the parity symbols/packets from the server/sender. These parity symbols/packets can be used at the client/receiver to recover the corrupted/lost information. This can be useful in that the data delivered over the wireless networks can experience both packet loss and random bit errors. To combat these problems, a layered-product-code based error protection scheme is provided in embodiments of the present invention. A product code can be described as being a two-dimensional code constructed by encoding a rectangular array of information bits logically arranged into rows and columns. In the array, one code is placed along a row and another code is placed along a column. To form the array, a channel encoder encodes compressed audio data that was encoded by a source encoder. The channel encoder encodes the compressed audio data by logically arranging it into increasing quality layers. Each layer is placed into a respective column. Each column is logically arranged into rows.

Figure 6:
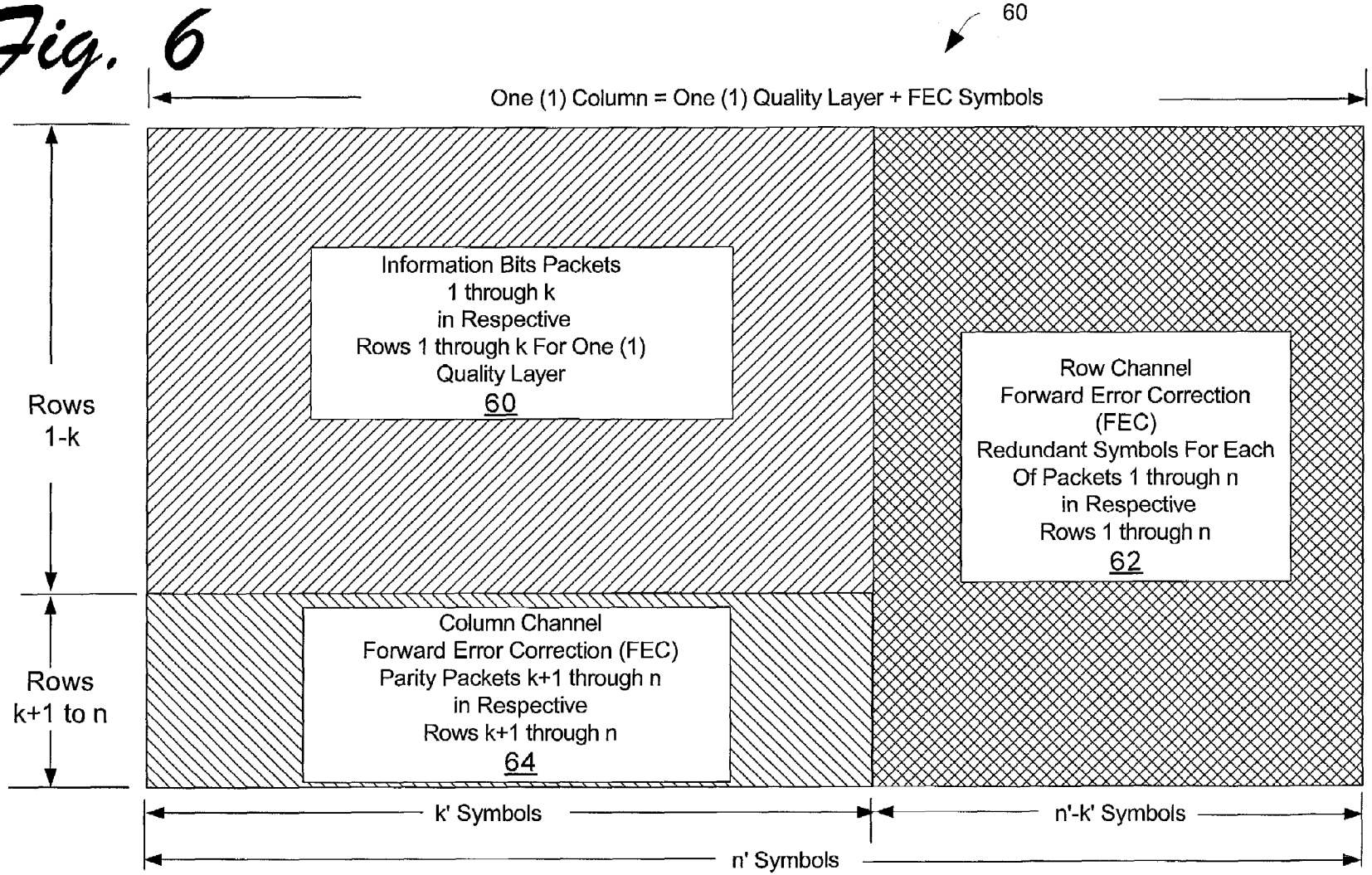
FIG. 6 depicts a data structure having a column with several rows each of which contains packets of data in accordance with a product code embodiment of the present invention.
Figure 7:
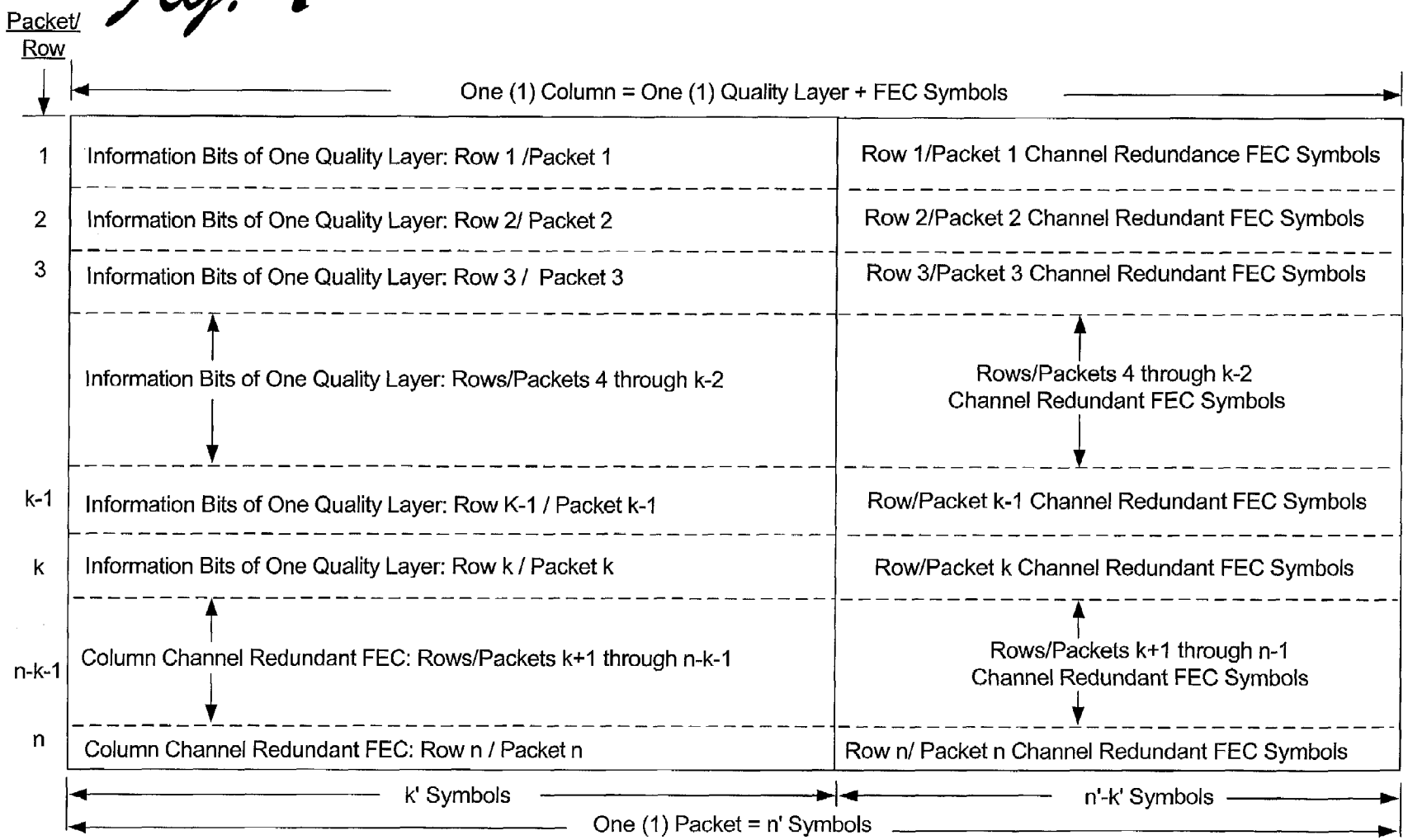
FIG. 7 depicts the data structure of FIG. 6 in greater detail.

As an FEC technique, each row in the array contains row channel protection codes for the respective column that corresponds to a respective layer. Additionally, each row will either have the compressed audio data from a respective layer or the row will have column channel protection codes in it. An example of an FEC technique in accordance with an embodiment of the present invention is seen in FIGS. 6-7 each of which depict a data structure where one (1) column has rows 1 through n and where rows 1 through k contain the compressed audio data from one (1) quality layer. Rows k+1 through n contain column channel FEC protection codes. Rows 1 through n contain row channel FEC protection codes. With particular reference to FIG. 6, a data structure 60 is depicted in which information bits 61 from one (1) quality layer are logically organizes into rows 1 through k. Column channel FEC 63 occupies rows k+1 through n. Each of rows 1 through n has row channel FEC 62 at the end of each packet for each respective row. Each row is a packet of channel encoded data.

Figure 8:
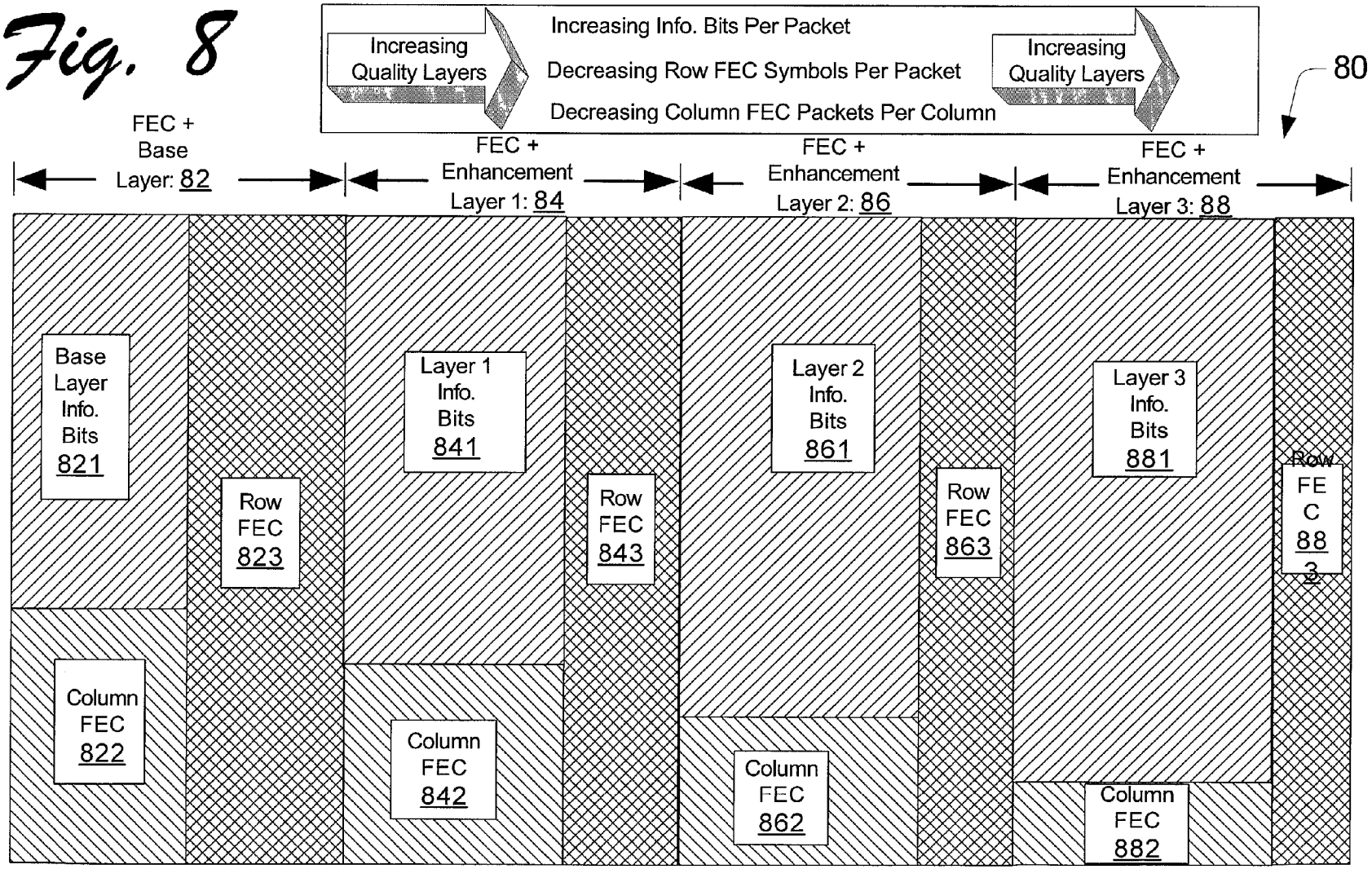
FIG. 8 depicts a plurality of the data structures seen in FIGS. 6-7, where a plurality of columns are shown, and where the columns contain progressively higher quality layers of compressed audio data.
Figure 9:
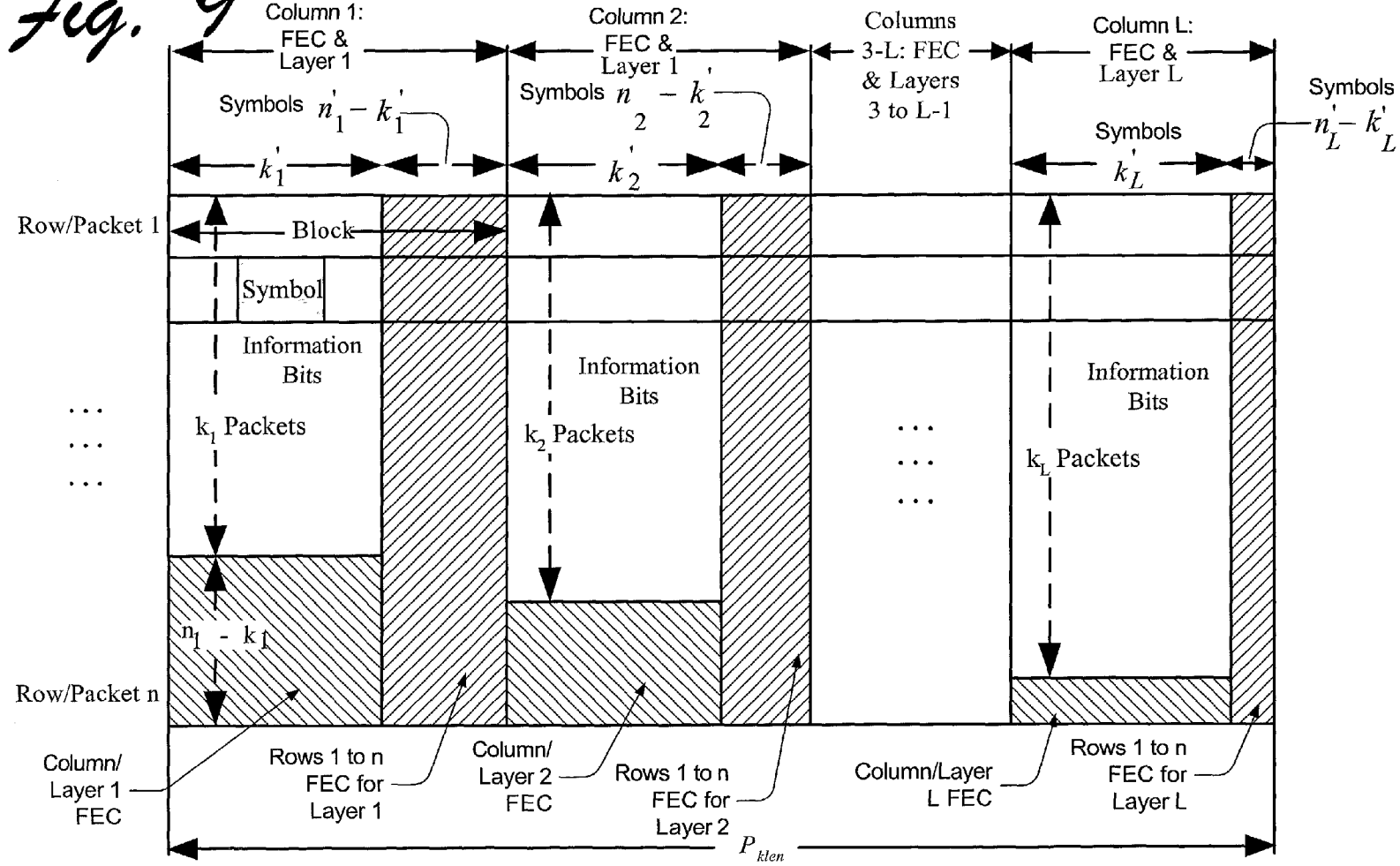
FIG. 9 depicts the plurality of the data structures of FIG. 8 in greater detail.

The array of rows and columns can be coded with row and column channel protection codes using unequal error protection (UEP) as is demonstrated in FIGS. 8-9. FIGS. 8-9 show multiple quality layers in a respective number of columns and depict an example of a UEP technique, where each column that has a layer that is of higher quality than that of another column will have fewer row and column channel protection codes and the compressed audio data will be greater. In another example, a source encoder can be used to encode audio data into compressed audio data logically arranged into a base layer and a plurality of increasing quality enhancement layers. A channel encoder can then be used to encode each of the base and enhancement layers into a respective column logically arranged into a plurality of rows. The channel encoder can add column FEC symbols to the respective column that corresponds to the respective base or enhancement layer. Row FEC symbols can be added by the channel encoder to the respective row that corresponds to the respective base or enhancement layer. As such, each row includes a packet of channel encoded data and each column includes a plurality of these packets. Each packet can include the row FEC symbols for the respective row. Additionally, each of the rows will have either the compressed audio data from one of the base and enhancement layers for the corresponding row and column or the row will have the column FEC symbols for the corresponding row and column.

With particular reference to FIG. 8, a data structure 80 is an example of unequal error protection in accordance with an embodiment of the present invention. Data structure 80 has four (4) layers, 82, 84, 86, 88 of progressively increasing quality. Specifically, layer 82 is a base layer and layer 84-88 are enhancement layers of progressively increasing quality. Each layer 82, 84, 86, 88 has respective sets of information bits 821, 841, 861, 881, column channel FEC 822, 842, 862, 882, and row channel FEC 823, 843, 863, 883. FIG. 8 shows that information bits 821, 841, 861, 881 are progressively greater in number with an increase in the quality of the respective layer 82, 84, 86, 88. It is also seen in FIG. 8 that column channel FEC 822, 842, 862, 882, and row channel FEC 823, 843, 863, 883 both decrease with an increase in the quality of the respective layer 82, 84, 86, 88.

Generally speaking, the row protection code is used to deal with the bit errors while the column protection code is used to deal with the packet losses. In practice, a lost packet not only loses the information data of the compressed audio data but also loses the redundancy of the row channel protection codes. Thus the row channel protection code can be helpful to reduce the effect of residual bit errors. Generally, a cluster of errors within a packet can be regarded as a symbol error for the column channel protection code. A lost packet also can be regarded as burst errors in the row direction with the known error position in the column direction. Therefore the column channel protection code can be used to not only can handle the packet losses but also the bit errors.

Embodiments of the present invention can use shortened Reed-Solomon (RS) protection codes in both the row and the column directions for error protection, although other embodiments of the present invention are not limited to such codes. Reed Solomon protection codes are a subset of Bose-Chaudhuri-Hochquenghem (BCH) codes and are linear block codes. These block codes can be used for error protection against bursty packet losses because they can be maximum distance separable codes, i.e. there are no other codes that can reconstruct erased symbols from a smaller number of received code symbols. A Reed-Solomon code is specified as RS (n, k) with s-bit symbols. This means that the encoder takes k data symbols of s bits each and adds parity symbols to make an n symbol codeword. There are n−k parity symbols of s bits each. A Reed-Solomon decoder can correct up to t symbols that contain errors in a codeword, where $$t = \left\lfloor \frac{n-k}{2} \right\rfloor.$$

With the knowledge of error position, it can correct up to t=n−k symbol errors. Given a symbol size s, the maximum codeword length, n, for a Reed-Solomon code is $n=2^s-1$. Reed-Solomon codes may be shortened by (conceptually) making a number of data symbols zero at the encoder, not transmitting them, and then re-inserting them at the decoder.

As discussed above, the data structure of the product code is depicted in FIGS. 6-9, where the resulting n packets make up one (1) block of packets (BOP). Across the packets, the column code, RS (n, k), encodes k information packets into n packets. Then the row code, RS (n', k'), encodes k' information symbols into n' symbols within each packets.

The symbol size of both RS (n, k) and RS (n', k') is set to eight (8) or one (1) byte for conveniently accessing information. The row channel protection code can be considered to be the lower-level channel code implemented in the physical layer, and the column channel protection code can be considered to be the upper-level channel protection code implemented in the application layer. Note that this scheme can be easily applied to other media that has a layered structure.

In a multi-layer scalable audio stream, the impact of the transmission errors in each layer is different. The data in the higher layer depends on the corresponding bits in the lower layer. That is, at the receiver side, if the corresponding information in the lower layer is lost or corrupted, the packet of the upper layer is treated as being lost no matter whether it is correctly received or not. Therefore it is natural to apply unequal error protection to different layers. At the sender side, the bitstreams of all the layers are multiplexed into one (1) block of packets (BOP) as shown in FIGS. 8-9. The number of packets in one (1) BOP, n, is equal to $$\frac{R}{P_{klen}},$$

which is determined by the total available bit rate, R, and the packet size, $P_{klen}$. The information bits in layer l are filled into $k_l$ blocks with a length of $k_l'$. The remaining $n-k_l$ packets in the BOP are filled with column channel protection codes (e.g. coding parities). Within the packet, the size of the block belonging to layer l is denoted as $n_l'$, with $k_l'$ information symbols. The left $n_l'n-k_l'$ symbols are used for the row channel coding. Therefore, for layer l in a BOP, n and $k_l$ determine the protection level along the column direction. Meanwhile, $n_l'$ and $k_l'$ determine the protection level along the row direction.

A group of frames, which lasts for T seconds, are packed into one (1) BOP. For layer l, it is advantageous to place each frame into a number of packets in order to synchronize at the beginning of the audio data of each frame. The total budget of the bit rate in one (1) BOP, R, is equal to BW×T, where BW is the available bandwidth for the audio streaming. The packet size, $P_{klen}$, can be a constant. Note that for a constant bit rate budget, R, of one (1) BOP, increasing the packet size implies reducing the number of the packets, n, and increasing the block size $n_l'$, for layer l. Considering the protection efficiency, reducing n results in a decreased efficiency of the column RS channel coding, while increasing $n_l'$ results in an increased efficiency of the row RS channel coding for layer l.

The structure of each BOP can be transmitted as side information to the receiver. This side information can contain the sequence number of the BOP, and the number of layers, L, in the BOP. Additionally, for each layer l, $1 \leqq l \leqq L$, the side information can contain the number of packets, $k_l$, that contain the information data for layer l, the number of information symbols, $k'_l$, that layer l occupies in each packet, and the number of redundant symbols, $n_l'-k'_l$, in each packet for layer l.

Since the size of the side information transmitted to the receiver can be small, it may be assumed that it can be successfully transmitted with the powerful enough forward error correction and automatic retransmission request (ARQ) error control techniques. Then, the target bit rate, R, of the scalable audio with the disclosed packetization scheme can be calculated as $$R = \sum_{l=1}^{L} \frac{n \times n_l'}{k_l \times k_l'} R_l, \tag{9}$$

where $R_l$ is rate of information data for layer l. Here, the size of the small side information is ignored.

The foregoing layered-product-code based UEP packetization scheme can be applied to different network conditions. As described above, the row channel protection codes mainly deal with the residual bit errors in the application layer. The row and column channel protection codes can be adjusted in both of these directions in each layer so as to adapt to the varying wireless network conditions and thereby appropriately accommodate the packet loss ratio and the random bit error rate.

IV. Bit Allocation for Scalable Audio Streaming over Wireless IP Networks

As was discussed above with respect to the general client/server network system and environment 100 depicted in FIG. 1, the status of a wireless IP network can be monitored periodically on the client/receiver side and a feedback of the monitoring can be sent back to the server/sender side from the client/receiver. The server/sender side can advantageously utilize the feedback to efficiently utilize the limited capacity of the wireless IP network under the inherently varying error conditions thereof in a bit allocation scheme, a discussion of which follows.

Under a given channel condition, additional FEC increases the error robustness while reducing the available bit rate for source coding. Thus there is a trade-off between source rate and FEC rate. Considering the different types of errors in wireless networks, i.e., packet losses and random bit errors, a discussion follows for a bit allocation scheme for allocating available bits between the source coding, the row protection coding, and the column protection coding based on a rate-distortion relation. This bit allocation scheme focuses upon the relation between two directional protections (e.g. rows and columns) and upon the dependent characteristic of scalable audio.

Based on the known wireless IP channel characteristics of packet losses and random bit errors, it is desirable to balance the tradeoff in error control by optimizing bit allocation to mitigate the effect of packet losses and random bit errors. The aim of bit allocation is to minimize the total distortion by determining for different layers the optimal source coding rates, column coding rates and row coding rates under a given target bit rate constraint.

For a given target rate R and a constant packet length PL, the number of packets $$n = \frac{R}{P_L}$$

is then known. Also defined are $\bar{k}=[k_1, \ldots, k_L]$; $\bar{n}'=[n_1', \ldots n_L']$; and $\bar{k}'=[k_1', \ldots, k_L']$. Then, the optimal bit allocation optimization problem can be formulated as the one that will minimize the end-to-end distortion $D(R)=D_s(R_s)+D_c(R_c)$ subject to the total rate constraint, where the distortion $D_s(R_s)$ is due to source coding at rate $R_s$ and the distortion $D_c(R_c)$ is due to channel coding with rate $R_c$. Stated otherwise:

min $D(R)=\min(D_s(R_s)+D_c(R_c))$ subject to $R_s+R_c \leqq R$, where $D_s(R_s)=A2^{-2R_s}$ with A being a constant, $$R_s = \sum_{i=1}^{L} R_i \quad \text{and} \quad R_c = \sum_{i=1}^{L} \left( \frac{n}{k_i} \frac{n_i'}{k_i'} - 1 \right) R_i.$$

The unknown variables in the above formulation are $R_l, \ldots, R_L$ and vectors $\bar{k}$, $\bar{n}'$, and $\bar{k}'$; the constraints are $$R = \sum_{l=1}^{L} \frac{n \times n_l'}{k_l \times k_l'} R_l \quad \text{and} \quad P_L = \sum_{i=1}^{L} n_i'.$$

This minimization problem differs from standard bit allocation problems because the expression for D(R) cannot be split into a sum of terms, each depending on a single unknown variable, and the total rate R is not a linear function of the unknown variables.

An analytical expression of $D_c(R_c)$, or the end-to-end distortion D(R)), is now discussed. It can be observed that there is a sequential dependency among data units in different layers in the source bitstream when deriving $D_c(R_c)$. Depending on the number of lost packets, the data units in the first layer are first examined to see if they can be decoded. Then, the data units in both the first and second layers are examined to see if they can be decoded, etc. In the mean while, row channel protection codes can be primarily viewed as a means of correcting bit errors in horizontal blocks within layers.

An end-to-end distortion analysis can be summarized as follows. The column RS codes for the L layers can be parameterized by $(n, k_1), (n, k_2), \ldots, (n, k_l)$ with $k_1 \leqq k_2 \leqq \ldots \leqq k_L$. Depending on the number of lost packets r $(0 \leqq r \leqq n)$, c(r) can be defined as $$c(r) = \arg\max_{j=0,\ldots,L} \{(n - k_j) > r)\};$$

then $$D(R) = D_s(R_s) + D_c(R_c)$$
$$= A2^{-2R_s} + \sum_{r=0}^{n} \left\{ P(r, n) \sum_{l=1}^{L} \left[ B(l, r) \left( \prod_{j=1}^{l-1} P_{dep}(j, c(r), r) \right) \Delta D_l \right] \right\},$$

where P(r, n) is the probability of losing r out of n packets, B(l, r) is the expected number of the erroneous blocks in the l-th layer when the number of lost packets is r, $P_{dep}(j,c(r),r)$ is the average probability of any block in the j-th layer being correctly decodable when c(r) layers can potentially be correctly decoded with r lost packets, and $\Delta D_l$ represents the distortion caused by one lost block in the l-th layer, which renders all remaining blocks in the same packet useless. The foregoing iterative procedure can be used to search for an optimal solution to the stated problem of bit allocation.

Figure 10:
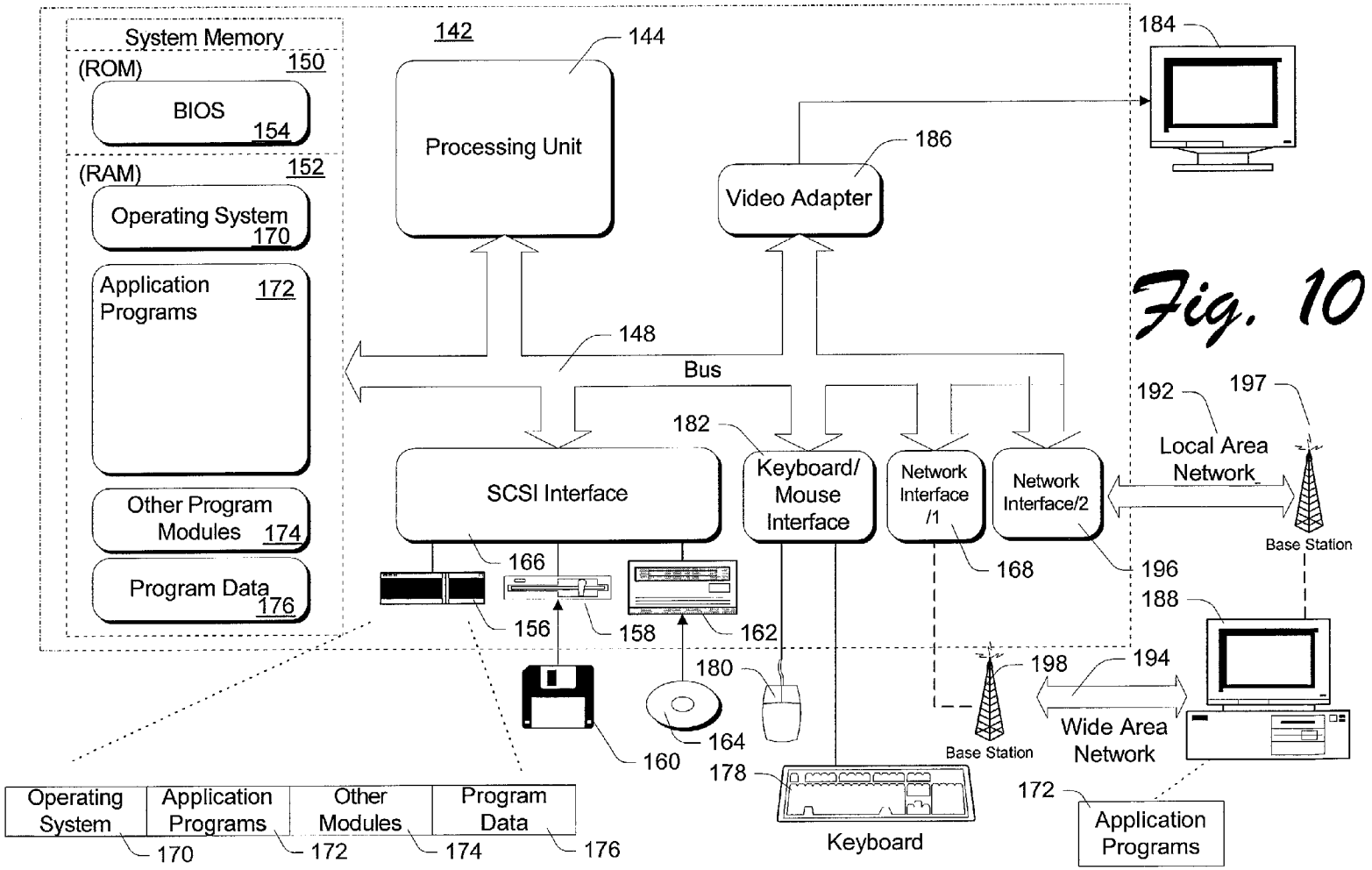
FIG. 10 is a block diagram, in accordance with an embodiment of the present invention, of a networked computer that can be used to implement either a server or a client.

FIG. 10 shows a general example of a computer 142 that can be used in accordance with the invention. Computer 142 is shown as an example of a computer or computational device that can perform the functions of any of the server/sender 20 or client/receiver 40 of FIG. 1 or any of the network client computers 104 or network server computers 102 of FIG. 4. Computer 142 includes one or more processors or processing units 144, a system memory 146, and a system bus 148 that couples various system components including the system memory 146 to processors 144.

The bus 148 represents one or more of any of several types of bus structures, including a memory bus or memory controller, a peripheral bus, an accelerated graphics port, and a processor or local bus using any of a variety of bus architectures. The system memory includes read only memory (ROM) 150 and random access memory (RAM) 152. A basic input/output system (BIOS) 154, containing the basic routines that help to transfer information between elements within computer 142, such as during start-up, is stored in ROM 150. Computer 142 further includes a hard disk drive 156 for reading from and writing to a hard disk (not shown), a magnetic disk drive 158 for reading from and writing to a removable magnetic disk 160, and an optical disk drive 162 for reading from or writing to a removable optical disk 164 such as a CD-RW, a CD-R, a CD ROM, or other optical media.

Any of the hard disk (not shown), magnetic disk drive 158, optical disk drive 162, or removable optical disk 164 can be an information medium having recorded information thereon. The information medium has a data area for recording stream data, such as a scalable audio bitstream having one data unit of one coded bit-plane as seen in FIG. 3. By way of example, each data unit can be encoded and decoded by an ERSAC codec executing in processing unit 144, as describe above. As such, the encoder distributes the stream data so that the distributed stream data can be recorded using an encoding algorithm, such as is used by an ERSAC encoder.

The hard disk drive 156, magnetic disk drive 158, and optical disk drive 162 are connected to the system bus 148 by an SCSI interface 166 or some other appropriate interface. The drives and their associated computer-readable media provide nonvolatile storage of computer readable instructions, data structures, program modules and other data for computer 142. Although the exemplary environment described herein employs a hard disk, a removable magnetic disk 160 and a removable optical disk 164, it should be appreciated by those skilled in the art that other types of computer readable media which can store data that is accessible by a computer, such as magnetic cassettes, flash memory cards, digital video disks, random access memories (RAMs), read only memories (ROM), and the like, may also be used in the exemplary operating environment.

A number of program modules may be stored on the hard disk, magnetic disk 160, optical disk 164, ROM 150, or RAM 152, including an operating system 170, one or more application programs 172, other program modules 174, and program data 176. A user may enter commands and information into computer 142 through input devices such as keyboard 178 and pointing device 180. Other input devices (not shown) may include a microphone, joystick, game pad, satellite dish, scanner, or the like. These and other input devices are connected to the processing unit 144 through an interface 182 that is coupled to the system bus 148. A monitor 184 or other type of display device is also connected to the system bus 148 via an interface, such as a video adapter 186. In addition to the monitor 184, personal computers typically include other peripheral output devices (not shown) such as speakers and printers.

Computer 142 operates in a networked environment using logical connections to one or more remote computers, such as a remote computer 188. The remote computer 188 may be another personal computer, a server, a router, a network PC, a peer device or other common network node, and typically includes many or all of the elements described above relative to computer 142. The logical connections depicted in FIG. 10 include a local area network (LAN) 192 or a wide area network (WAN) 194. Such networking environments are commonplace in offices, enterprise-wide computer networks, intranets, and the Internet. In the described embodiment of the invention, remote computer 188 executes an Internet Web browser program such as the Internet Explorer® Web browser manufactured and distributed by Microsoft Corporation of Redmond, Wash.

When used in a LAN networking environment, computer 142 is connected to the local network 192, which further establishing connection to the remote computer 188 through base station 197. Computer 142 connected to local network 192 through a network interface or adapter 196. When used in a WAN networking environment, computer 142 typically directly connects to a base station 198, which further establishing communications to remote computer 188 over the wide area network 194, such as the Internet. The base station 198 is connected to the system bus 148 via a network interface 168. In a networked environment, program modules depicted relative to the personal computer 142, or portions thereof, may be stored in the remote memory storage device. It will be appreciated that the network connections shown are exemplary and other means of establishing a communications link between the computers may be used.

Generally, the data processors of computer 142 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described above in conjunction with a microprocessor or other data processor. The invention also includes the computer itself when programmed according to the methods and techniques described above. Furthermore, certain sub-components of the computer may be programmed to perform the functions and steps described above. The invention includes such sub-components when they are programmed as above. In addition, the invention described herein includes data structures, described below, as embodied on various types of memory media.

For purposes of illustration, programs and other executable program components such as the operating system are illustrated herein as discrete blocks, although it is recognized that such programs and components reside at various times in different storage components of the computer, and are executed by the data processor(s) of the computer.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method comprising:

encoding compressed audio data into increasing quality layers;

logically arranging each of the quality layers of the encoded compressed audio data into columns and the columns into rows; and applying row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

2. The method as defined in claim 1, further comprising:

signal-processing input audio signals;

quantizing the signal-processing input audio signals into quantized data of weighted subbands; and bit-plane coding the quantized data into the encoded compressed audio data logically arranged into increasing quality layers and being defined in an embedded audio bitstream of bit planes, wherein:

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions.

3. The method as defined in claim 2, wherein each said data unit further comprises a last partition having dummy zeros, whereby the data unit is byte-aligned.

4. The method as defined in claim 2, wherein:

said quantizing quantizes using a variable length coding algorithm having a finite code;

the bit-plane coding executes a predetermined coding method; and the predetermined coding method generates the third partition as an invalid codeword for the predetermined coding method.

5. The method as defined in claim 4, wherein the invalid codeword has a significant Hamming distance from valid codewords of the predetermined coding method.

6. A computer-readable medium encoded with computer-executable instructions, which when executed on a processor, direct a computer to perform claim 1.

7. A method comprising:

source encoding audio data into compressed audio data logically arranged into a base layer and a plurality of increasing quality enhancement layers;

channel encoding each of the base and enhancement layers into a respective column logically arranged into a plurality of rows;

adding column Forward Error Correction (FEC) symbols to the respective column that corresponds to the respective base or enhancement layer; and adding row FEC symbols to the respective row that corresponds to the respective base or enhancement layer, wherein:

each said row includes a packet;

each said column includes a plurality of said packets; and each said packet includes:

the row FEC symbols for the respective row; and one of:

the compressed audio data from one of the base and enhancement layers for the corresponding row and column; or the column FEC symbols for the corresponding row and column.

8. The method as defined in claim 7, wherein for any said column including one said layer that is of higher quality than that of another said column:

the number of said packets containing the column FEC symbols is lower;

the number of said row FEC symbols in the respective rows is lower; and the compressed audio data in each of the respective packets is higher.

9. The method as defined in claim 1, wherein, as compared to other said columns, the column including the base layer has:

more of said packets containing said column FEC symbols;

more of said row FEC symbols in the respective rows thereof; and less of said the compressed audio data.

10. The method as defined in claim 7, wherein the source encoding audio data into compressed audio data logically arranged into a base layer and a plurality of increasing quality enhancement layers comprises:

signal-processing input audio signals;

quantizing the signal-processing input audio signals into quantized data of weighted subbands; and bit-plane coding the quantized data into the encoded compressed audio data logically arranged into increasing quality layers and being defined in an embedded audio bitstream of bit planes, wherein:

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions.

11. The method as defined in claim 10, wherein each said data unit further comprises a last partition having dummy zeros, whereby the data unit is byte-aligned.

12. The method as defined in claim 10, wherein:

said quantizing quantizes using a variable length coding algorithm having a finite code;

the bit-plane coding executes a predetermined coding method; and the predetermined coding method generates the third partition as an invalid codeword for the predetermined coding method.

13. The method as defined in claim 12, wherein the invalid codeword has a significant Hamming distance from valid codewords of the predetermined coding method.

14. A computer-readable medium encoded with computer-executable instructions, which when executed on a processor, direct a computer to perform claim 7.

15. A scalable audio coding apparatus comprising:

a channel encoder for:

logically arranging encoded compressed audio data into increasing quality layers, each layer being logically arranged into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

16. The scalable audio coding apparatus as defined in claim 15, further comprising:

a signal processor for signal-processing input audio signals;

a quantizer for quantizing the signal processed input audio signals into quantized data of weighted subbands; and a source encoder for bit-plane coding the quantized data into the encoded compressed audio data logically arranged into increasing quality layers and being defined in an embedded audio bitstream of bit planes, wherein:

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions.

17. The scalable audio coding apparatus as defined in claim 16, wherein each said data unit further comprises a last partition having dummy zeros, whereby the data unit is byte-aligned.

18. The scalable audio coding apparatus as defined in claim 16, wherein:

the quantizer quantizes using a variable length coding algorithm having a finite code;

the bit-plane coding of encoder executes a predetermined coding method; and the predetermined coding method generates the third partition as an invalid codeword for the predetermined coding method.

19. The scalable audio coding apparatus as defined in claim 18, wherein the invalid codeword has a significant Hamming distance from valid codewords of the predetermined coding method.

20. A computer usable medium having embodied thereon a computer program for coding audio signals, the computer program comprising:

a first code segment to:

logically arrange compressed audio data into increasing quality layers, each layer being arranged into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

21. The computer usable medium as defined in claim 20, wherein the computer program further comprises:

a second code segment for signal-processing input audio signals;

a third code segment for quantizing the signal processed input audio signals into quantized data of weighted subbands;

a fourth code segment to affect bit-plane coding the quantized data into an embedded audio bitstream of bit planes that are logically arranged into the increasing quality layers, wherein:

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions.

22. The computer usable medium as defined in claim 21, wherein the computer program further comprises:

a fifth code segment to form a last partition of said data having dummy zeros, whereby the data unit is byte-aligned.

23. The computer usable medium as defined in claim 21, wherein:

a fifth code segment uses a variable length coding algorithm having a finite code to quantize the signal processed input audio signals into quantized data of weighted subbands;

a sixth code segment executes a predetermined bit-plane coding method; and the predetermined bit-plane coding method generates the third partition as an invalid codeword for the predetermined bit-plane coding method.

24. The computer usable medium as defined in claim 23, wherein the invalid codeword has a significant Hamming distance from valid codewords of the predetermined bit-plane coding method.

25. A data structure, embodied on one or more computer-readable media, comprising compressed audio data logically arranged into increasing quality layers into respective columns, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

26. The data structure as defined in claim 25, wherein:

the increasing quality layers comprise a base layer and a plurality of enhancement layers;

the column protection codes comprise column FEC symbols that correspond to the respective base or enhancement layer; and the row protection codes comprise row FEC symbols that correspond to the respective base or enhancement layer, wherein:

each said row includes a packet;

each said column includes a plurality of said packets; and each said packet includes:

the row FEC symbols for the respective row; and one of:

the compressed audio data from one of the base and enhancement layers for the corresponding row and column; or the column FEC symbols for the corresponding row and column.

27. The data structure as defined in claim 26, wherein for any said column including one said layer that is of higher quality than that of another said column:

the number of said packets containing the column FEC symbols is lower;

the number of said row FEC symbols in the respective rows is lower; and the compressed audio data in each of the respective packets is higher.

28. The data structure as defined in claim 26, wherein, as compared to other said columns, the column including the base layer has:

more of said packets containing said column FEC symbols;

more of said row FEC symbols in the respective rows thereof; and less of said the compressed audio data.

29. The data structure as defined in claim 25, wherein the compressed audio data logically arranged into increasing quality layers is defined in an embedded audio bitstream of bit planes, wherein:

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions.

30. The data structure as defined in claim 29, further comprising one or more zero in an end portion of the data structure, whereby the data structure is aligned with a respective byte.

31. The data structure as defined in claim 29, wherein each said data unit further comprises a last partition having dummy zeros, whereby the data unit is byte-aligned.

32. The data structure as defined in claim 29, wherein the third partition has an invalid codeword for a predetermined coding method used to form the compressed audio data logically arranged into increasing quality layers.

33. The data structure as defined in claim 32, wherein the invalid codeword has a significant hamming distance from valid codewords of the predetermined coding method.

34. A method comprising reconstructing packets of compressed audio data of increasing quality layers by arranging each said layer into a respective column and each said column into rows, wherein:

each said row has row and column protection codes for the respective row and column that correspond to the respective layer;

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

35. The method as defined in claim 34, further comprising:

decoding the rows and columns, wherein:

the rows and columns define an embedded audio bitstream of bit-planes;

the decoding decodes the embedded audio bitstream of bit-planes into quantized data of weighted subbands;

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits, wherein the third partition is between the second and fourth partitions; and dequantizing the quantized data of weighted subbands into audio signals.

36. The method as defined in claim 35, wherein each said data unit further comprises a last partition having dummy zeros, whereby the data unit is byte-aligned.

37. The method as defined in claim 35, wherein the second code segment decodes using Reversible exponential Golomb (Exp-Golomb) codewords in a Reversible Variable Length Code (RVLC) algorithm.

38. The method as defined in claim 37, wherein the decoding:

decodes each said second partition having one or more contiguous coded significance bits using Reversible Exp-Golomb codewords that include a variable-length prefix part and a fixed-length suffix part;

performs error detection in the variable-length prefix of the coded significance bits in both forward and backward directions to detect an invalid codeword; and identifies a location of the invalid codeword upon detection.

39. The method as defined in claim 38, wherein, upon identification of the location of the invalid codeword, the decoding:

compares a result of the error detection in the forward direction with a result of the error detection in the backward direction; and accepts, for the decoding of the second partition, identical portions of the variable-length prefix of the coded significance bits as determined by the results of the error detection in the forward and backward directions.

40. A scalable audio decoding apparatus comprising:

a channel decoder to reconstruct packets of compressed audio data of increasing quality layers and to arrange each said layer into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

41. The scalable audio decoding apparatus as defined in claim 40, further comprising:

a source decoder to decode the rows and columns, wherein:

the rows and columns define an embedded audio bitstream of bit-planes;

the source decoder decodes the embedded audio bitstream of bit-planes into quantized data of weighted subbands;

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits;

the third partition is between the second and fourth partitions; and an inverse quantizer to dequantize the quantized data of weighted subbands into audio signals.

42. The scalable audio decoding apparatus as defined in claim 41, wherein each said data unit further comprises a last partition having dummy zeros, whereby the data unit is byte-aligned.

43. The scalable audio decoding apparatus as defined in claim 41, wherein the source decoder decodes using Reversible exponential Golomb (Exp-Golomb) codewords in a Reversible Variable Length Code (RVLC) algorithm.

44. The scalable audio decoding apparatus as defined in claim 43, wherein the source decoder:

decodes each said second partition having one or more contiguous coded significance bits using Reversible Exp-Golomb codewords that include a variable-length prefix part and a fixed-length suffix part;

performs error detection in the variable-length prefix of the coded significance bits in both forward and backward directions to detect an invalid codeword; and identifies a location of the invalid codeword upon detection.

45. The scalable audio decoding apparatus as defined in claim 44, wherein, upon identification of the location of the invalid codeword, the source decoder:

compares a result of the error detection in the forward direction with a result of the error detection in the backward direction; and accepts, for the decoding of the second partition, identical portions of the variable-length prefix of the coded significance bits as determined by the results of the error detection in the forward and backward directions.

46. A computer usable medium having embodied thereon a computer program for coding audio signals, the computer program comprising:

a first code segment to reconstruct packets of compressed audio data of increasing quality layers and to arrange each said layer into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater.

47. The computer usable medium as defined in claim 46, wherein the computer program further comprises:

a second code segment to decode the rows and columns, wherein:

the rows and columns define an embedded audio bitstream of bit-planes;

the second code segment decodes the embedded audio bitstream of bit-planes into quantized data of weighted subbands;

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions; and an inverse quantizer to dequantize the quantized data of weighted subbands into audio signals.

48. The computer usable medium as defined in claim 47, wherein each said data unit further comprises a last partition having dummy zeros, whereby the data unit is byte-aligned.

49. The computer usable medium as defined in claim 47, wherein the second code segment decodes using Reversible exponential Golomb (Exp-Golomb) codewords in a Reversible Variable Length Code (RVLC) algorithm.

50. The computer usable medium as defined in claim 49, wherein the second code segment:

decodes each said second partition having one or more contiguous coded significance bits using Reversible Exp-Golomb codewords that include a variable-length prefix part and a fixed-length suffix part;

performs error detection in the variable-length prefix of the coded significance bits in both forward and backward directions to detect an invalid codeword; and identifies a location of the invalid codeword upon detection.

51. The computer usable medium as defined in claim 50, wherein, upon identification of the location of the invalid codeword, the second code segment:

compares a result of the error detection in the forward direction with a result of the error detection in the backward direction; and accepts, for the decoding of the second partition, identical portions of the variable-length prefix of the coded significance bits as determined by the results of the error detection in the forward and backward directions.

52. A system comprising a sender apparatus including:

a source encoder for coding compressed audio data into logically arranged increasing quality layers;

a channel encoder for logically arranging each layer into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater;

a sender transmitter element for sending a transmission of the rows and columns;

an interconnected network in communication with the sender apparatus; and a receiver apparatus in communication with the interconnected network and including:

a receiver reception element for receiving the transmission of the rows and the columns in a plurality of packets over the interconnected network;

a channel decoder to reconstruct the plurality of packets into the logical arrangement of the rows and the columns; and a source decoder to decode the rows and columns into audio signals.

53. The system as defined in claim 52, wherein:

the source encoder bit-plane codes quantized data of weighted subbands into the encoded compressed audio data logically arranged into increasing quality layers;

the rows and columns define an embedded audio bitstream of bit-planes;

the source decoder decodes the embedded audio bitstream of bit-planes into quantized data of weighted subbands; and an inverse quantizer dequantizes the quantized data of weighted subbands into the audio signals.

54. The system as defined in claim 52, wherein:

the increasing quality layers are defined in an embedded audio bitstream of bit planes;

the embedded audio bitstream includes binary data having bits; each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions.

55. The system as defined in claim 52, wherein: the receiver apparatus further comprises:

a network monitor for monitoring the interconnected network; and a receiver transmitter element for sending a transmission reflecting the monitoring of the interconnected network in a network feedback transmission addressed to the sender apparatus; and the sender apparatus further comprises:

a sender reception element for receiving the network feedback transmission; and means for using the network feedback transmission to allocate bits to the source encoder and the channel encoder.

56. The system as defined in claim 55, wherein: the network monitor monitors the interconnected network for:

the Bit Error Rate (BER);

the fading depth;

the mobile speed of the receiver apparatus;

the transmission delay; and the packet loss ratio of the packets; the receiver transmitter element transmits:

the transmission of the network feedback transmission to the sender apparatus in an IP protocol over the interconnected network;

the BER, the fading depth, and the mobile speed of the receiver apparatus on the physical layer;

the transmission delay on the data link layer; and the packet loss ratio on the application layer; and the sender apparatus allocate bits to the source encoder and the channel encoder by deriving a status of the interconnected network and an estimate of the available bandwidth of the interconnected network from:

the Bit Error Rate (BER);

the fading depth;

the mobile speed of the receiver apparatus;

the transmission delay; and the packet loss ratio of the packets.

57. The system as defined in claim 52, wherein:

the sender apparatus uses the network feedback transmission to allocate bits to:

the source encoder to bit-plane code the quantized data into encoded compressed audio data; and the channel encoder to arrange the rows and the columns.

58. A system comprising:

a server machine including:

a signal processor for signal-processing input audio signals;

a quantizer for quantizing the signal processed input audio signals into quantized data of weighted subbands;

a source encoder for bit-plane coding the quantized data into encoded compressed audio data logically arranged into increasing quality layers and being defined in an embedded audio bitstream of bit planes, wherein:

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions; a channel encoder for:

logically arranging the encoded compressed audio data logically arranged into increasing quality layers, each layer being logically arranged into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater;

a sender reception element for receiving a network feedback transmission; and a sender transmitter element for sending a transmission of the rows and columns;

an interconnected network in communication with the sewer machine; and a client machine in communication with the interconnected network and including:

a network monitor for monitoring a status of the interconnected network;

a receiver transmitter element for sending a transmission of the status of the interconnected network in the network feedback transmission to the server machine;

a receiver reception element for receiving a transmission of a plurality of packets containing the rows and the columns;

a channel decoder to reconstruct the packets of compressed audio data of increasing quality layers and to arrange each said layer into a respective column, each column being logically arranged into rows, each row having row and column protection codes for the respective row and column that correspond to the respective layer, wherein:

for the corresponding row and column, each row contains the row protection codes and one of:

the compressed audio data from the respective layer; or the column protection codes; and for any said column including one said layer that is of higher quality than that of another said column, the row and column protection codes are fewer and the compressed audio data is greater;

a source decoder to decode the rows and columns, wherein:

the rows and columns define an embedded audio bitstream of bit-planes;

the source decoder decodes the embedded audio bitstream of bit-planes into quantized data of weighted subbands;

the embedded audio bitstream includes binary data having bits;

each said bit-plane has a data unit that includes:

a beginning partition having one or more contiguous refinement bits;

a second partition having one or more contiguous coded significance bits;

a third partition having one or more contiguous sign boundary mark bits; and a fourth partition having one or more contiguous coded sign bits; and the third partition is between the second and fourth partitions; and an inverse quantizer to dequantize the quantized data of weighted subbands into audio signals;

wherein the server machine uses the network feedback transmission to allocate bits to:

the source encoder to bit-plane code the quantized data into encoded compressed audio data; and the channel encoder to logically arrange the rows and the columns.

* * * * *